United States Patent [19]

Lee

[11] 4,372,489

[45] Feb. 8, 1983

[54] ELECTRICAL TOY VEHICLE TRACKS

[75] Inventor: Cheuk-Ming Lee, Hong Kong, Hong Kong

[73] Assignee: The Refined Industry Company Limited, Hong Kong, Hong Kong

[21] Appl. No.: 174,337

[22] Filed: Aug. 1, 1980

[30] Foreign Application Priority Data

Aug. 8, 1979 [GB] United Kingdom ..... 7927609

[51] Int. Cl.[3] ..... A63H 18/12; A63H 19/30; E01B 23/00

[52] U.S. Cl. ..... 238/10 F; 46/1 K; 238/10 E

[58] Field of Search ..... 46/1 K, 1 R; 238/10 E, 238/10 F

[56] References Cited

U.S. PATENT DOCUMENTS

| | | | |
|---|---|---|---|
| 2,711,857 | 6/1955 | Vanetzian et al. | 238/10 E |
| 4,082,220 | 4/1978 | Cheng et al. | 46/1 K X |
| 4,106,695 | 8/1978 | Carella et al. | 238/10 F |
| 4,286,752 | 9/1981 | Cheng | 46/1 K X |

FOREIGN PATENT DOCUMENTS

| | | | |
|---|---|---|---|
| 1524605 | 9/1978 | United Kingdom | 238/10 F |

*Primary Examiner*—Robert B. Reeves
*Assistant Examiner*—Howard Beltran
*Attorney, Agent, or Firm*—Townsend and Townsend

[57] ABSTRACT

A track section for use with an electrically actuated toy vehicle and which can be joined end to end with other identical track sections to complete a vehicle track. The section includes at least one vehicle path and at least two electrically-conducting strips from which the vehicle obtains its electrical power. The strips extend from end to end of the section. The end of each strip is in a recess which tapers width-wise in a direction away from the end of the section. The recess is formed by an abutment wall adjacent to the end of the strip and a cam wall inclined to the longitudinal axis of the section. The cam wall is adapted to engage a corresponding cam wall on an adjacent section when the two sections are brought together so as to move the ends of the strips of the two sections into side-by-side engagement between respective abutment walls of the two sections. The section has a snap-fit retainer so that two sections can be releasably coupled together. The retainer includes a ledge having an open-end mouth for receiving a lug on an adjacent section. The lug enters and leaves the mouth along a path generally parallel to the cam surfaces.

11 Claims, 12 Drawing Figures

ELECTRICAL TOY VEHICLE TRACKS

This invention relates to toy vehicle tracks and in particular track sections which are capable of being joined end to end to complete a vehicle track along which one or more toy vehicles is arranged to pass.

BACKGROUND TO THE INVENTION

Many types of vehicle tracks of this nature are well-known and can be used to assemble layouts defining a track along which, for example, toy cars can be raced under the control of an individual controller or along which a toy vehicle can pass to form part of a model road layout.

There should be good electrical continuity between the electrically conducting strips of each track section so that a vehicle will run evenly around the track and in particular there should be continuity of electrical supply to the vehicle as it crosses the joint between two track sections. Many existing track sections leave much to be desired in these respects.

In addition, the end of existing track sections contain many jagged and pointed edges which are liable to injure the fingers of children assembling these sections. Further the ends of the electrically conducting strips, which are normally metal strips, are liable to become bent and damaged so reducing the chance of making good electrical connections when track sections are assembled.

The invention has been made with these points in mind and it is an object of the present invention to reduce or overcome such problems.

BRIEF SUMMARY OF THE INVENTION

According to the invention there is provided a toy vehicle track section either end of which is capable of being joined to either end of a like track section to assemble a vehicle track, the section including at least one defined path for a vehicle including at least two electrically-conducting strips from which a vehicle obtains electrical power, the strips extending from end to end of the section substantially parallel to one another and to the longitudinal axis of the section, an individual tapered recess adjacent the ends of each electrical strip at each end of the section, the respective end of the strip terminating not beyond the end of its individual recess so that each recess houses an individual end of the strip, and each recess tapering width-wise of the section in a direction away from the end of the section, the recess including an abutment wall adjacent the end of the electrically-conducting strip and a cam wall inclined to the longitudinal direction of the section and arranged to engage a corresponding cam wall on the end of another section when two sections are brought together and to wedge the ends of the strips contained within those recesses into side by side engagement between the respective pair of abutment walls, and also at each end of the section, snap-fitting retaining means for maintaining the adjacent sections joined, the snap-fitting means including an open ended mouth having a restricted opening and a lug capable of entering the mouth through the opening and being held in the mouth by virtue of the resiliency of the mouth and/or lug, the direction in which the lug enters and leaves the mouth being generally parallel to the said cam surfaces of the recesses and so inclined to the longitudinal axis of the section.

In a track section according to the invention, the recesses house the ends of electrically-conducting strips, normally metal strips, and so these strips are protected from damage and distortion before the sections are assembled and, in addition, the ends of the metal strips which might be sharp cannot harm the fingers or the like of a person assembling the sections. Preferably, the ends of the metal strips are rounded so that they are not sharp.

Further, as two track sections are brought together, the ends of two electrical strips contact one another and an excellent electrical connection is given and there is substantially no bending of the metal strips from a position extending length-wise of the sections and this greatly simplifies assembly of a track section. Any bending which does occur is merely of the order of the thickness of the strip as a result of the ends laying alongside one another.

To improve the contact between the ends of two electrical strips, small projections, e.g. in the form of a semi-circular pip or hump, can be provided on the abutment walls.

A track section according to the invention can be straight or curved and of any desired length so that upon assembling a number of such sections an endless track can be formed.

The invention is applicable to all types of vehicle track and in particular car racing tracks. At the present moment, there are possibly two main types of such track.

On type of track is used in, what is known as slot racing. The other type of track has no slot but instead has three parallel, spaced, electrically-conducting strips and the sides of the track are raised so as to retain the vehicles on the track.

A toy track section according to the invention can carry any desired number of vehicle paths. In addition, track sections can be designed to provide special effects and so whilst it will normally be the case that the vehicle paths will be substantially parallel to one another and spaced across the width of the track section, whether the track section be straight or curved, special effect track sections such as those where one or more paths across one another or temporarily come closer to one another, can be provided.

Preferably, the ends of a track section according to the invention do not have jagged protruding portions. As a result, it is desirable that all of the portions at the ends of the section terminate substantially on a line which is at right angles to the longitudinal axis of the section.

The snap-fitting retaining means are desirably positioned adjacent the longitudinal centre line of the track with one or more vehicle paths on either side of that centre line.

The outer sides of each track section preferably have engaging means such that when track sections are assembled, the outer edges engage one another and so the top running surfaces of the track are held smoothly in alignment at the edges. This is preferably achieved by providing a recess at one side of the track section and a corresponding lug at the other side which is arranged to engage in the recess and so align the top running surfaces when two sections are joined.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
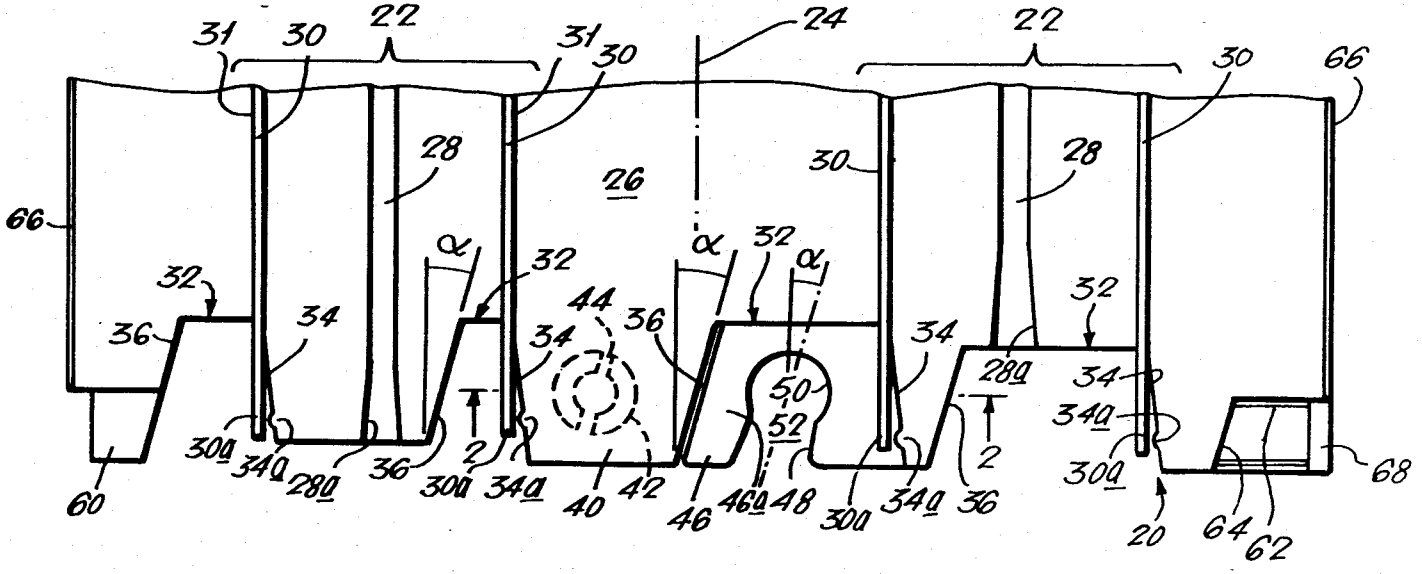
FIG. 1 is a plan view of the end of one embodiment of a toy track section according to the invention.
Figure 2:
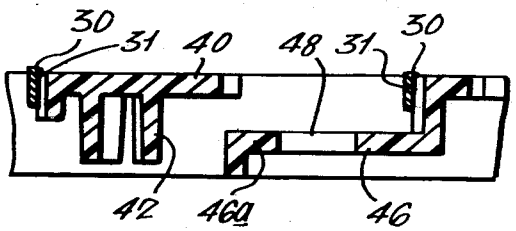
FIG. 2 is a section taken on the line 2—2 of FIG. 1.
Figure 3:
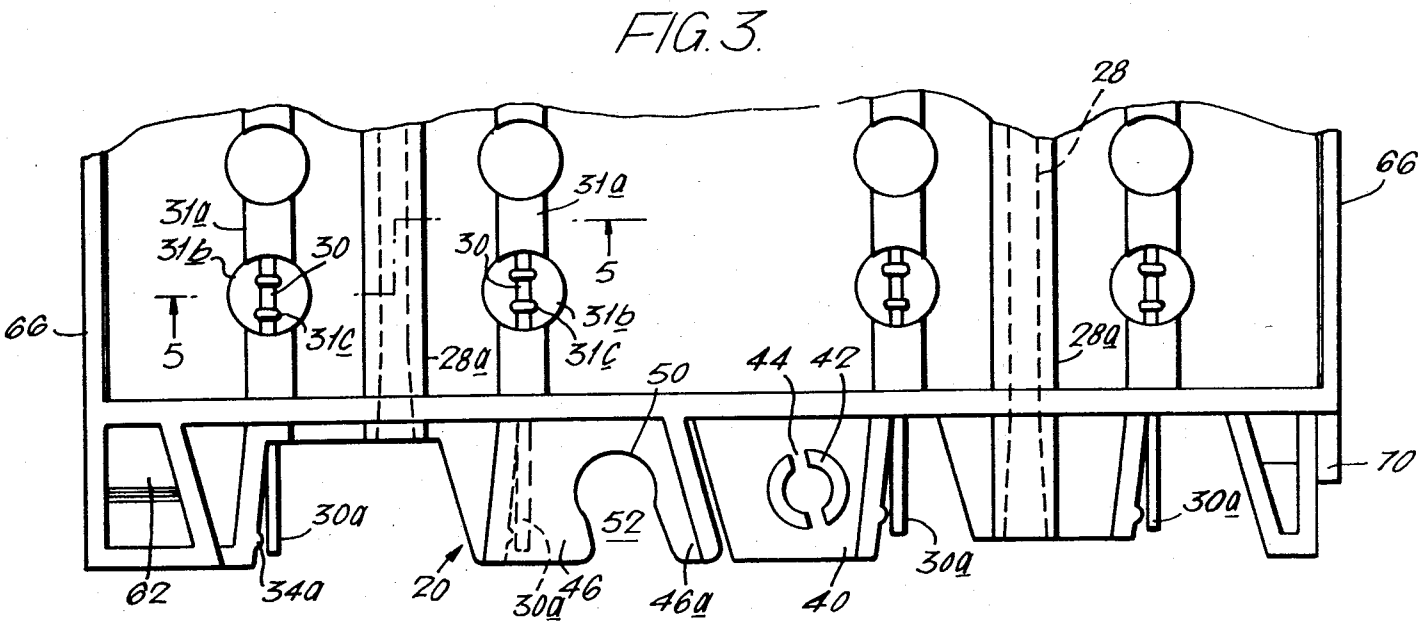
FIG. 3 is an underplan view of the track section shown in FIG. 1.

The toy track section 20 shown in FIGS. 1 to 7 is of the type which has a pair of vehicle paths 22 parallel to one another and spaced equally on either side of a centre line 24 of the section on the top running surface 26 of the section.

Each path 22 includes a slot 28 formed in a downwardly depending U-shaped channel 28*a* for the reception of a pin or the like projecting downwardly from a toy vehicle and for guiding the vehicle. In addition, on either side of the slot 28 are provided metal strips 30 which are housed in narrow slots 31 which are formed in downwardly directed U-shaped channels 31*a*. At intervals along the channels 31*a* circular cut-outs 31*b* are provided to expose the underside of the metal strips 30 and in these cut-out regions the strips 30 are peened over at points 31*c* to secure the metal strips in the slots 31.

As best seen in FIG. 1 the terminal portions 30*a* of each metal strip 30 are housed in an individual tapering recess 32. Each recess tapers in a direction longitudinally of the section 20 away from the end of the section and each recess 32 includes an abutment wall 34 adjacent to the terminal portion 30*a* and only slightly inclined thereto and a cam wall 36 each of which is inclined to the longitudinal direction 24 at an angle $\alpha$ of about 15°. Provided on the abutment walls 34, are semicircular humps 34*a*.

Between the two paths 22 is provided a snap-fitting arrangement to secure adjacent sections 20 to one another. The snap-fitting arrangement includes a tongue 40 which is flush with the top surface of the track section and which is defined at its edges by an abutment wall 34 and a cam wall 36 forming parts of different recesses 32. A circular pin 42 projects down from the tongue 40 and has a diametrical cut 44 so as to allow the pin 42 to be resiliently compressed.

Figure 4:
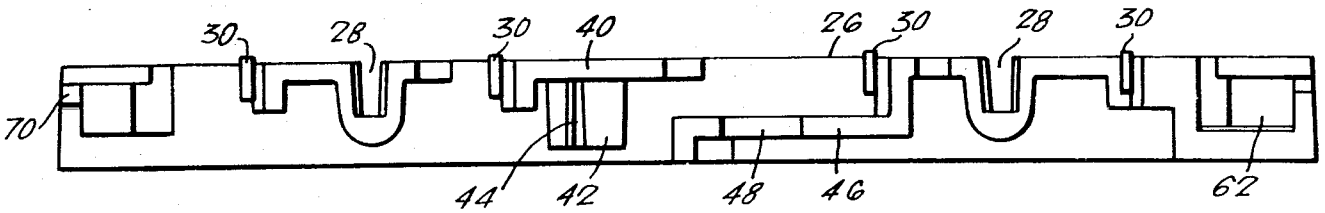
FIG. 4 is an end elevation of the section shown in FIG. 1.
Figure 5:
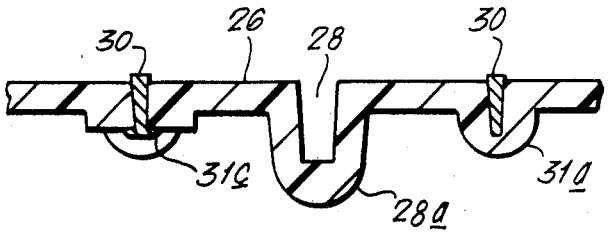
FIG. 5 is a section taken on the line 5—5 of FIG. 3.

A ledge 46 is provided adjacent the tongue 40 on the other side of the centre line 24. As best shown in FIG. 4 this ledge is spaced downwardly from the top surface 26 of the track section so that it can fit beneath a tongue 40. The ledge 46 is positioned across a recess 32. The ledge 46 has formed in it an open-ended slot 48 having an enlarged rounded end 50. The axis of the slot 52 is inclined at the angle $\alpha$ to the centre line 24. Its width is such that the pin 42 can enter the open-ended slot and will be a snap-fit within the enlarged end 50. The resilience of the pin 42 and/or the resilience of the arm 46*a* of the ledge allow the pin to enter the slot and become a snap-fit within the rounded end 50.

Figure 6:
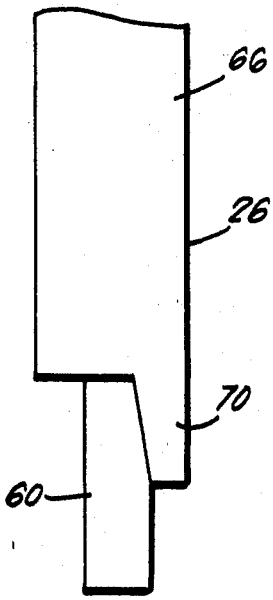
FIG. 6 is a side elevation taken from the right hand side of FIG. 1.
Figure 7:
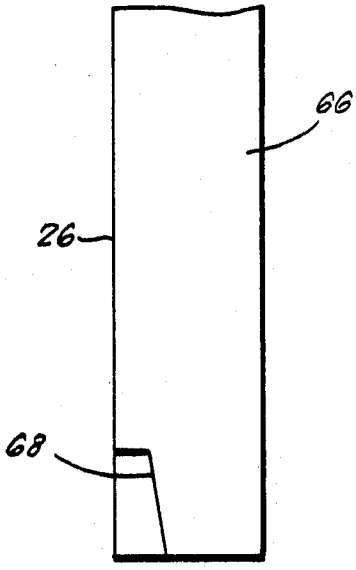
FIG. 7 is a side elevation taken from the left hand side of FIG. 1.

In order to ensure that the top running surfaces 26 of adjacent sections are flush right across the track when two sections are joined, the track has, as best shown in FIGS. 1, 3, 4, 6 and 7, engaging means at either side. Thus, on the left hand side, as shown in FIG. 1, the track has a forwardly extending lug 60 which, as shown best in FIG. 6, is spaced downwardly from the surface 26. One wall of this lug is defined by a cam wall 36 of the adjacent recess 32. At the right hand side of the section shown in FIG. 1, there is provided a corresponding recess 62 shaped to receive the lug 60 and including a wall 64 inclined at the same angle as the cam wall 36 forming part of the lug 60.

In addition, the side wall 66 of the track on which the track rests, includes an inclined cut-out 68 which, when two track sections are engaged, receives a projecting tongue 70 on the other side of the section. The tongue 70 and cut-out 68 are dimensioned so that when the two mate, the running surfaces 26 of adjacent sections are held accurately in alignment.

Figure 8:
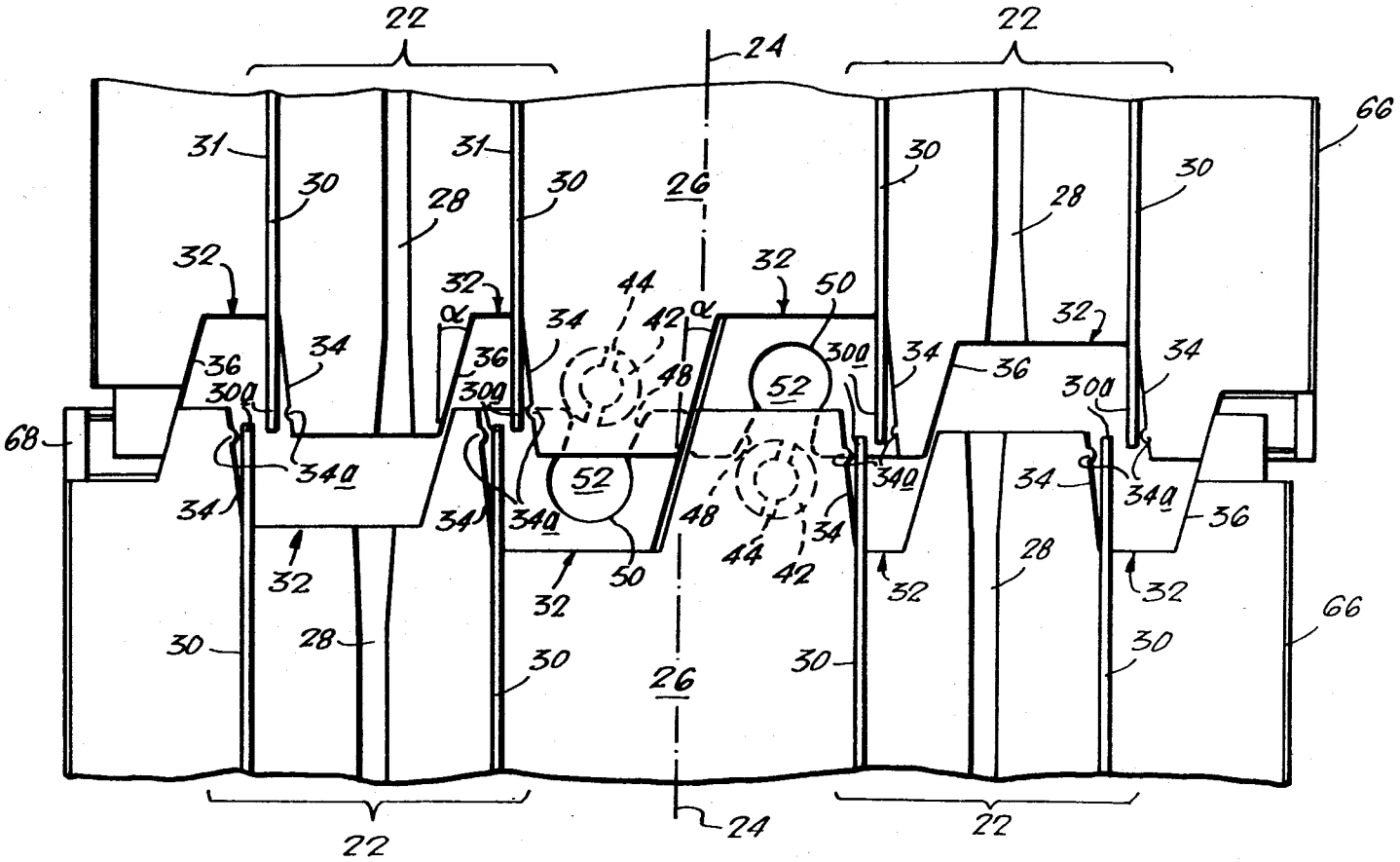
FIG. 8 is a plane view showing two track sections as shown in FIG. 1 in the process of being assembled.
Figure 9:
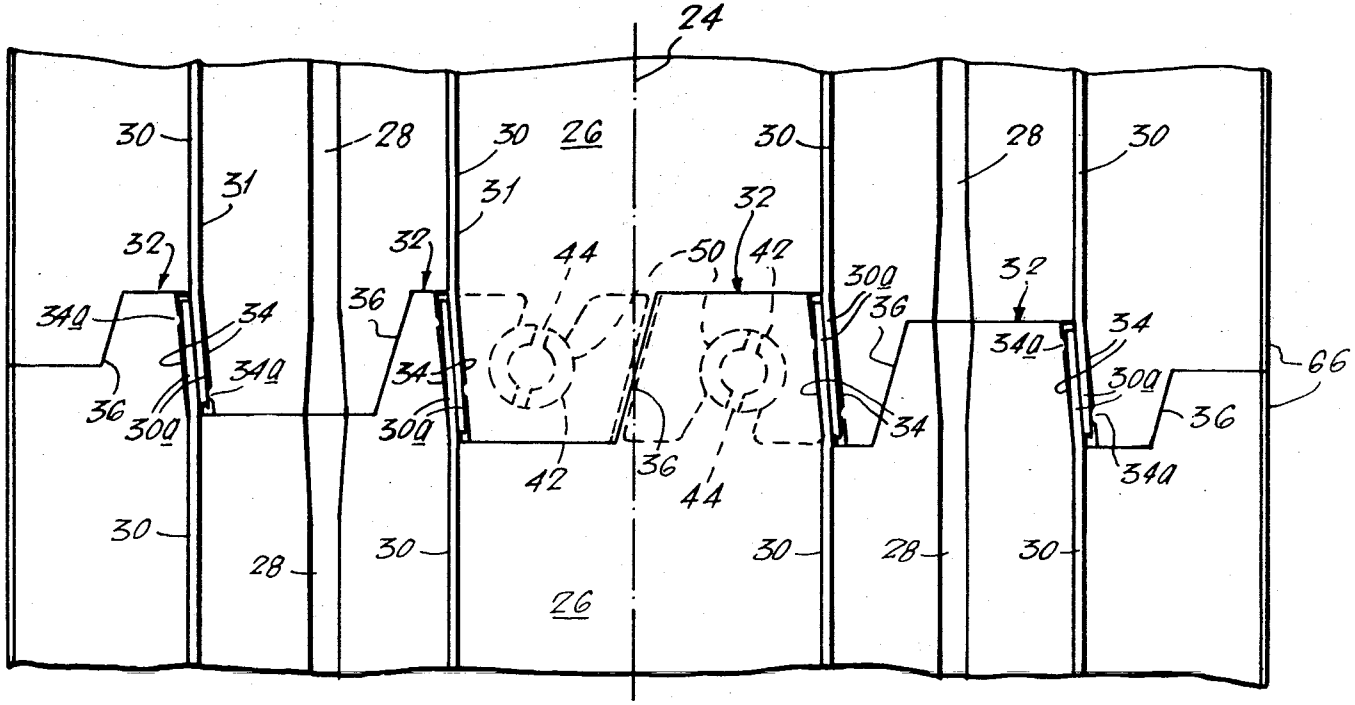
FIG. 9 is a plane view showing two of the track sections shown in FIG. 1 joined together.

In order to assemble adjacent track sections 20 the two ends are brought together as shown in FIG. 8 with the centre lines 24 of the two sections displaced slightly from one another. The cam surfaces 36 of engaging recesses are brought together to the position shown in FIG. 8 and then the two sections are moved relative to one another at the angle $\alpha$ until the recesses fully engage one another at which point as shown in FIG. 9 the axes 24 of the two sections are aligned.

As shown in FIG. 8 when the two sections initially contact one another, the adjacent terminal portions 30*a* of the metal strips do not engage but, as the two sections slide together at the angle $\alpha$ to the centre line 24, adjacent terminal portions engage one another side by side. Continued movement towards the final engaged position causes the sides of the terminal portions to rub along one another so cleaning them for improved electrical contact and in addition the terminal portions bend very slightly so that they are in good electrical contact. The extent of bending is slight and is limited to the thickness of the sections and the slight inclination of the walls 34 to the centre line 24. In addition the humps 34*a* locally force adjacent portion 30*a* into close contact.

As the two sections are brought together from the position shown in FIG. 8, the pins 42 enter the open ends of slots 48 until the sections are fully engaged at which point the pins have become a snap-fit within the rounded ends 50 so holding the two sections together. The force required for this is not particularly great but the effect of engagement of the two pins in their respective rounded ends 50 is sufficient to hold the two track sections securely together for the purposes of use particularly since forces which tend to separate the sections during use will be in the direction of the centre lines 24 and not at the angle $\alpha$ thereto.

In addition, as explained earlier, the lug 60 engages in the recess 62 and the cut-out 68 and tongue 70 become engaged at the edges of the track sections and assist in aligning the top surfaces 26 so as to provide a smooth continuous running surface.

As can be seen from FIG. 9 at the junction between two sections there is very smooth electrical continuity between the engaging terminal portions 30*a* and so when a toy vehicle is running across the junction, it receives an excellent continuity of electrical supply.

The slots 28 near their ends 28*a* are, as best seen in FIG. 1, slightly flared so as to ensure smooth passage of the pin on the underside of the vehicle from one track section to the next.

Figure 10:
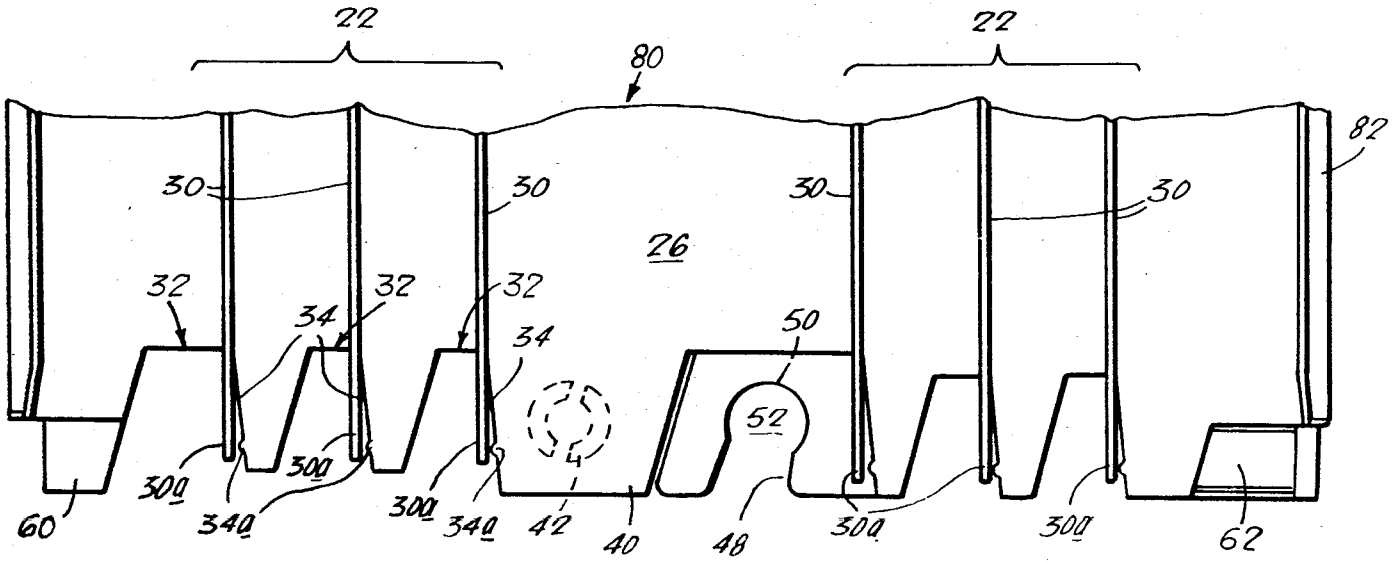
FIG. 10 is a plan view of the end of another embodiment of a toy track section according to the invention.
Figure 11:
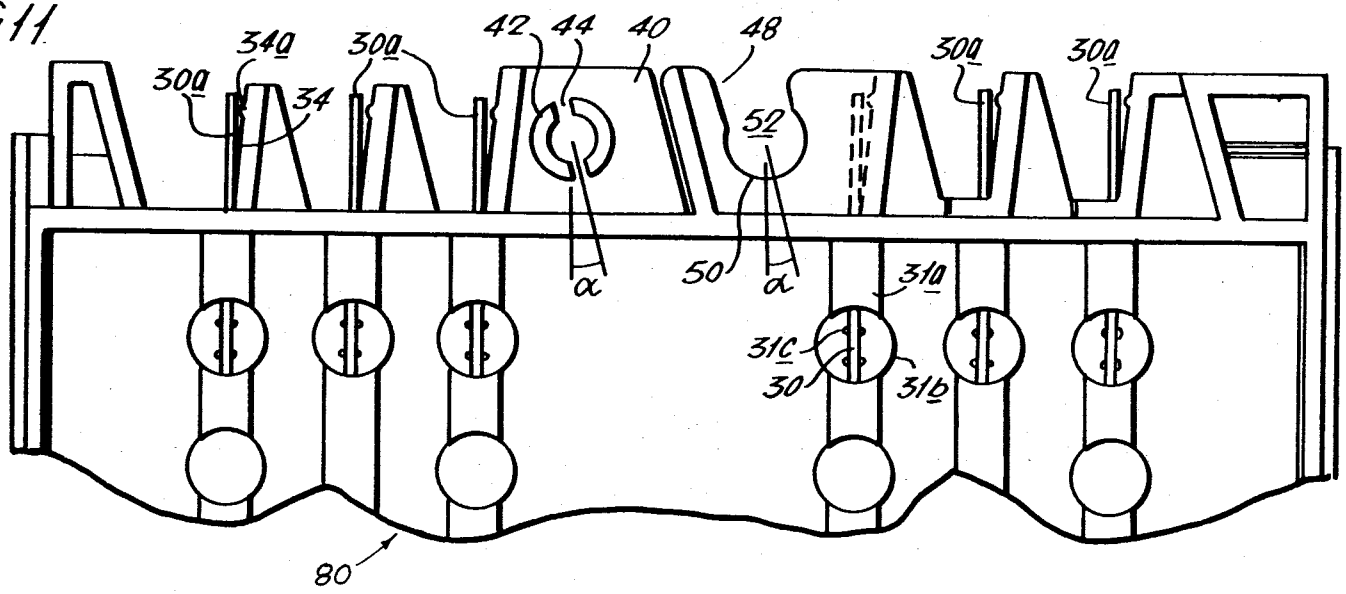
FIG. 11 is an underplan view of the track section shown in FIG. 10.
Figure 12:
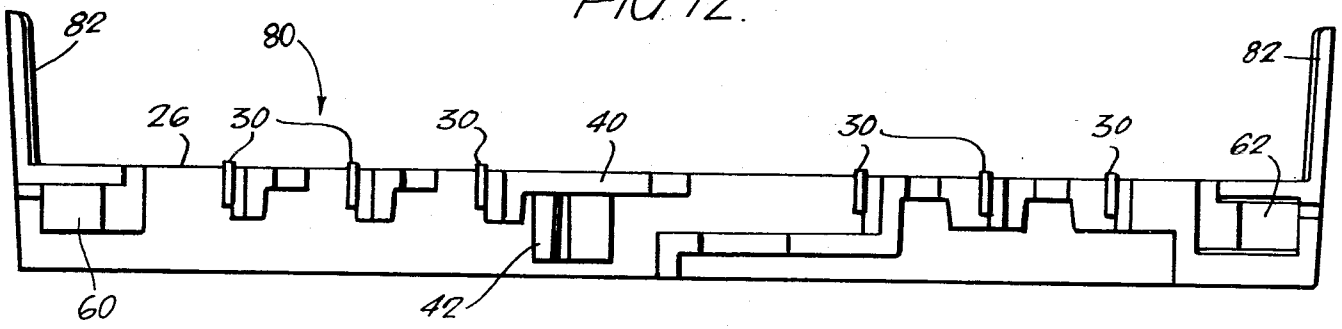
FIG. 12 is an end elevation of this track section shown in FIG. 10.

The toy track section 80 shown in FIGS. 10 to 12 is in many respects similar to the toy track section 20 and similar parts have been given identical reference numerals and will not be further described.

The major differences between the track sections are that the section 80 has three metal strips 30 for each vehicle path 22 and no slot such as the slot 28 in section 20 is provided. This means that an extra recess 32 is provided adjacent the terminal portion 30*a* of each extra strip 30.

In addition, at the edges of the track section there are upstanding side walls 82 for preventing toy vehicles transversing the paths 22 from leaving the top running surface 26.

The way in which the terminal portions 30*a* of adjacent sections engage and the way in which adjacent sections are engaged by means of the pins 42 and the slots 48 and the ways in which the lug 60 and recess 62 engage, are identical with those described in connection with the track section 20 and will not therefore be further described.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

I claim:

1. A toy vehicle track section capable of being joined to the end of a like track section to assemble a vehicle track, said section comprising:

means forming at least one defined path for a vehicle including at last two electrically-conducting strips from which a vehicle obtains electrical power, said strips being substantially straight throughout their lengths and extending from end to end of said section substantially parallel to one another and to the longitudinal axis of said section, an individual tapered recess adjacent the end of each said electrical strip, respectively, at each end of said section, said end of each strip terminating in its said individual recess so that each recess houses an end of a respective strip, each recess tapering width-wise of said section in a direction away from the respective end of said section, each recess being defined by an abutment wall adjacent the end of the respective strip and a cam wall inclined relative to the longitudinal axis of said section, said cam wall being adapated for engaging a corresponding cam wall on the end of another, adjacent section when the sections are brought together to cause the ends of the strips adjacent to the cam walls of the two sections to be moved into side by side engagement with each other between said respective pair of abutment walls, the ends of said strips of the two sections being substantially straight when the sections are brought together, and snap-fitting retaining means at each end, respectively of said section, for releaseably connecting the section with an adjacent section, said snap-fitting means comprising means defining an open ended mouth having a restricted opening and a lug extending transversely of the path, said lug being capable of entering the mouth of an adjacent section through the opening of the mouth when the sections are brought together and being releasably held in said mouth after the sections have been brought together, one of said defining means and said lug being resilient, the longitudinal axis of said mouth and thereby the direction in which said lug of said section enters and leaves said mouth of the adjacent section being generally parallel to said cam wall of said section.

2. A track section according to claim 1 in which projections are provided on said abutment walls to urge the ends of said electrical strips into firm contact when two track sections are joined.

3. A track section according in claim 1 in which said section further comprises a slot extending lengthwise with an electrically-conducting strip on each side of said slot and parallel thereto.

4. A track section according to claim 1 in which three parallel, spaced electrically-conducting strips are provided.

5. A track section according to claim 1 further comprising two spaced vehicle paths which extend lengthwise along said track substantially parallel to one another.

6. A track section according to claim 1 in which said ends are positioned about the longitudinal centre line of said track, said portion of said one end on one side of the centre line is positioned to mate with said portion on said other side of the centre line.

7. A track section according to claim 1 in which said outer sides of said track section have engaging means such that when two sections are assembled, said outer edges engage one another and said top running surfaces are held smoothly in alignment at said edges.

8. A track section according to claim 1 in which said snap-fitting means includes a ledge having an open-ended slot defining said mouth and a split pin, siad slot being inclined to the longitudinal axis of said section at approximately the same angle as said cam wall and having an enlarged end into which said pin is received.

9. A track section according to claim 8 in which said section has an upper projecting portion which is flush with a top surface of said section, said pin depending from said upper projecting portion, said ledge being a projecting lower portion on said section which is capable of fitting beneath the upper projecting portion of an adjacent section.

10. A track section as set forth in claim 1, wherein means is provided on the lower edge of each strip, respectively, for coupling the strip to said section.

11. A track section as set forth in claim 10, wherein said coupling means includes a lateral projection integral with the lower edge of each strip and engaging a lower surface of the section.

* * * * *